US005540524A

United States Patent [19]

Gonsalves

[11] Patent Number: 5,540,524

[45] Date of Patent: Jul. 30, 1996

[54] CONCRETE SLAB FOUNDATION AND METHOD OF CONSTRUCTION

[75] Inventor: Matt Gonsalves, Concord, Calif.

[73] Assignee: Gonsalves & Santucci, Inc., Concord, Calif.

[21] Appl. No.: 255,044

[22] Filed: Jun. 7, 1994

[51] Int. Cl.[6] ..... E04B 5/38

[52] U.S. Cl. ..... 405/257; 52/223.6; 52/254; 52/576

[58] Field of Search ..... 405/229, 256, 405/257; 52/223.6, 223.7, 294, 576, 577, 223.8, 223.14; 264/228

[56] References Cited

U.S. PATENT DOCUMENTS

| | | | |
|---|---|---|---|
| 3,029,490 | 4/1962 | Middendorf | 264/228 |
| 3,237,357 | 3/1966 | Hutchings | 52/223.6 |
| 4,702,048 | 10/1987 | Millman | 52/169.5 |

FOREIGN PATENT DOCUMENTS

| | | |
|---|---|---|
| 1333090 | 12/1963 | France . |
| 1354926 | 12/1964 | France . |
| 35707 | of 1954 | Poland . |
| 191908 | 1/1923 | United Kingdom . |

*Primary Examiner*—William P. Neuder

*Attorney, Agent, or Firm*—Flehr, Hohbach, Test, Albritton & Herbert

[57] ABSTRACT

Concrete slab foundation and method of construction in which ground soil is graded to form a building pad, a plurality of plastic domes having top and side walls are placed in a rectilinear array on the pad, and concrete is poured over the domes to form a monolithic structure consisting of a gridwork of criss-crossing ribs between the side walls and a horizontally extending deck above the top walls. The concrete is prestressed with longitudinally extending tendons in the ribs, and the plastic domes are left in place as a permanent part of the foundation to serve as a moisture barrier at the under side of the deck and the lateral faces of the ribs.

12 Claims, 1 Drawing Sheet

CONCRETE SLAB FOUNDATION AND METHOD OF CONSTRUCTION

This invention pertains generally to building structures and, more particularly, to a concrete slab foundation and method of constructing the same.

Highly expansive soils such as the clay soils found in California and other parts of the country present a number of problems from the standpoint of building. Such soils expand and contract with changes in moisture content to a much greater extent than other soils, and this causes relatively large foundation and floor movements and excessive wall cracking. These problems arise regardless of whether a structure is built on piers and footings or on a concrete slab foundation.

Some years ago, an experimental foundation having a raised concrete floor was built by others for a house in San Ramon, Calif. in an effort to alleviate the problems caused by the highly expansive clay soil in the area. That foundation had a horizontally extending slab, with a grid of concrete beams or ribs supporting the slab above the ground. This foundation was formed as a monolithic structure by pouring concrete over an array of inverted cardboard boxes which rested on grade and were intended to disintegrate in the void spaces beneath the floor. The structure was reinforced with mild steel mesh in the floor and mild steel bars in the beams.

The experimental foundation had significant advantages over footings and piers and conventional slab-on-grade foundations. It was relatively uniform and strong in both directions, and provided a stiffness not found in the more conventional floor systems commonly used in residential structures. With the increased stiffness, loads transferred to the floor and beam grid from bearing walls were spread evenly over a large area, substantially eliminating any variation in load. In addition, the beam grid had a much smaller area of contact with the expansive soil than a conventional slab foundation, and the expanding soil could flow into the void areas between the beams, rather than shifting the foundation.

The experimental foundation was constructed by grading the soil to form a level building pad, placing outer forms for a house, garage, fireplace and front porch, placing inner forms to break the floor elevation into different levels for a step-down family room and kitchen, installing rough plumbing, placing the cardboard boxes within the other forms, and pouring and finishing the concrete. This process was less expensive than conventional techniques for constructing foundations in that there was no trenching for footings, no cleaning of trenches, and no pre-soaking of the pad. Moreover, the entire foundation (slab, footings, garage and porches) was cast in a single pour, and the need for separate steel placement in different parts of the foundation was eliminated.

Despite its substantial advantages, the experimental foundation did have certain limitations and disadvantages. Measurements of a house built on the foundation have shown that there has been some shifting of the structure. There has also has been an undesirable seepage of moisture through the floor even though the floor is raised above the ground.

It is in general an object of the invention to provide a new and improved concrete slab foundation and method of constructing the same.

Another object is to provide a foundation and method of the above character which overcome limitations and disadvantages of foundations and methods heretofore contemplated.

Another object is to provide a foundation and method of the above character which are particularly suitable for use with expansive soils.

These and other objects are achieved in accordance with the invention by providing a concrete slab foundation and method of construction in which ground soil is graded to form a building pad, a plurality of plastic domes having top and side walls are placed in a rectilinear array on the pad, and concrete is poured over the domes to form a monolithic structure consisting of a gridwork of criss-crossing ribs between the side walls of the domes and a horizontally extending deck above the top walls of the domes. The concrete is prestressed with longitudinally extending tendons in the ribs, and the plastic domes are left in place as a permanent part of the foundation to serve as a moisture barrier at the under side of the deck and the lateral faces of the ribs.

Figure 1:
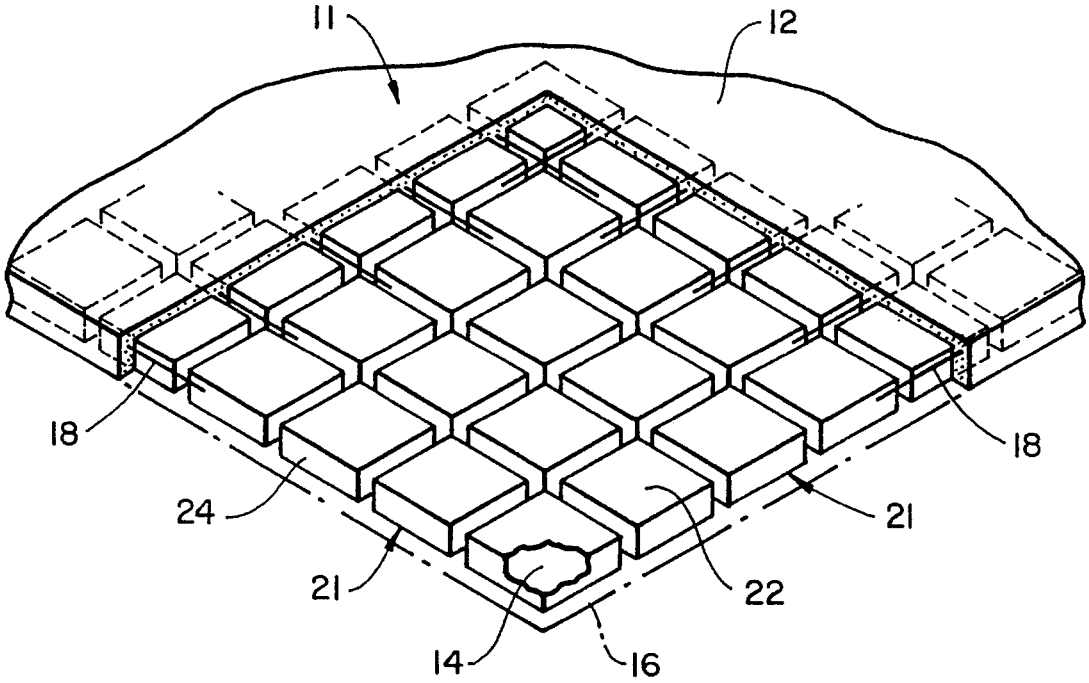
FIG. 1 is an isometric view, partly broken away, of one embodiment of a concrete slab foundation incorporating the invention.
Figure 2:
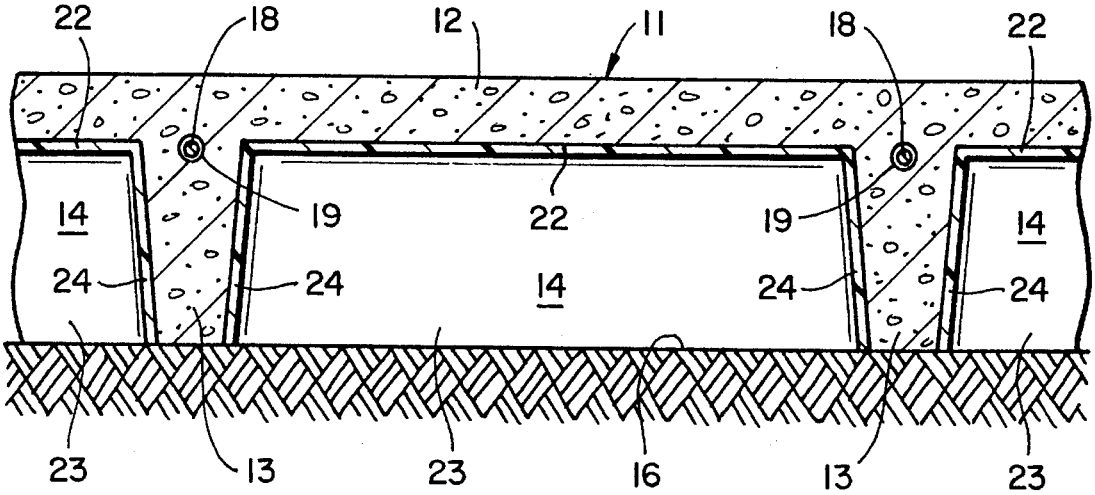
FIG. 2 is an enlarged cross-sectional view taken along line 2—2 in FIG. 1.

As illustrated in the drawings, the foundation 11 has a horizontally extending deck 12 and a gridwork of criss-crossing ribs 13 beneath the deck, with void spaces 14 between the ribs, and the ribs at outer edges of the structure serving as a perimeter beam. The soil beneath the foundation is graded to form a level pad 16, and the ribs rest on the pad. The ribs are tapered in cross-sectional profile and decrease in thickness toward the ground. In one presently preferred embodiment, for example, the deck is on the order of 4 inches thick, the void spaces or cells are on the order of 36 inches square at the top and 38 inches at the bottom, the lower surface of the deck is about 12 inches above the ground, and the ribs have a thickness on the order of 6 inches toward the top and 4 inches toward the bottom. As discussed more fully hereinafter, the deck and ribs are formed as a monolithic structure by a single pour of concrete.

The concrete is prestressed by means of tendons 18 which extend longitudinally within the upper portions of the ribs. The tendons are positioned at the centers of mass formed by the ribs and the adjacent sections of the deck, and in a foundation having the dimensions given above, the tendons are positioned on the vertical centerlines of the ribs approximately 4½ inches below the upper surface of the slab. With the criss-crossing ribs, the tendons extend in two mutually perpendicular directions and prestress the concrete in both directions.

The prestressing places the concrete in compression and substantially enhances its strength, particularly in the areas of the deck which span the void areas or cells between the ribs. With the prestressing, there is no need for mesh in the deck since the concrete above the cells functions as an arch.

In the preferred embodiment, the concrete is prestressed by post-tensioning of the tendons. The tendons consist of cables which are placed in sheaths 19 which are placed in the forms before the concrete is poured. After the concrete has set, the tendons are tensioned with jacks or other suitable means (not shown), then anchored to the concrete to apply the prestress. The jacks are then released and removed. If additional bonding between the tendons and the concrete is desired, grout can be forced into the sheaths to bond the cables to the sheaths.

Alternatively, the concrete can be prestressed by pretensioning of the tendons, in which case the tendons are placed in the forms and stretched between external abutments. The concrete is then placed in the forms and allowed to set. When the concrete has gained sufficient strength, the external pull on the tendons is released, transferring the prestress to the concrete. This method of prestressing is not as advantageous as post-tensioning in this particular application since a large buttress is required in order to stretch the tendons before the concrete has set, whereas in the post-tensioning process, the jacks can bear against the concrete itself in stretching the tendons.

The concrete is poured over a plurality of plastic domes 21 arranged in a rectilinear array on the pad 16. Unlike the test slab where the cardboard box forms were intended to disintegrate, the plastic domes are a permanent part of the structure. In addition to serving as forms to define the various parts of the concrete structure (i.e., the deck, ribs, and void spaces or cells beneath the deck) during the placement of the concrete, they serve as a moisture barrier at the under side of the deck and the lateral faces of the ribs of the finished structure. They are fabricated of a suitable plastic material such as PVC or ABS which has the strength to support the concrete until it sets and will be impervious to moisture thereafter. In the embodiment with the dimensions given above, each of the domes has a top wall 22 which is on the order of 36 inches square, an open bottom 23 on the order of 38 inches square, and side walls 24 on the order of 12 inches high. In this particular embodiment, the domes are positioned with the top walls of adjacent ones of the domes spaced apart by a distance on the order of 6 inches and the lower edges of the side walls about 4 inches apart. The taper of the domes produces the corresponding taper in the ribs formed beneath the slab when the concrete is poured.

The foundation is constructed by first grading the ground soil to form a level pad 16, then erecting conventional forms (not shown) to define the perimeter of the structure. The plastic domes 21 are then placed on the pad in a rectilinear array within the perimeter forms, and the rough plumbing (not shown) is installed. The tendons 18 and sheaths 19 are placed in the forms and supported in their desired positions by suitable means of known design. The concrete is then poured over the domes, finished and allowed to set.

When the concrete has gained sufficient strength, the tendons are stretched with jacks which bear against opposite sides of the structure, and anchored to the concrete. Once the tendons have been anchored, the jacks are released and removed, leaving the concrete in the prestressed condition. If desired, grout can be packed into the sheaths to provide further bonding between the tendons and the concrete.

The plastic domes 21 remain in the structure and serve as a permanent barrier for moisture at the under side of the deck and the lateral faces of the ribs.

If different floor levels are desired in the deck for different parts of the house, e.g. a step-down living room or family room, the pad is graded accordingly, and the same size domes are used throughout the structure. This, unlike the experimental foundation where different form heights were used for different floor levels, provides a uniform rib height and uniform slab thickness throughout the structure.

The invention has a number of important features and advantages. It eliminates the need for trenching and pre-soaking of the pad, and results in a foundation which is extremely rigid and stable for use on expansive soils. The prestressing of the concrete eliminates the need for mesh in the deck, and the relatively narrow edges along the bottoms of the ribs minimize the amount of contact with the ground. As in the case of the experimental foundation, expanding soil can flow into the voids between the ribs, rather than shifting all or part of the foundation. In addition, the plastic domes provide a permanent moisture barrier for the under side of the deck and the lateral faces of the ribs.

It is apparent from the foregoing that a new and improved concrete slab foundation and method of construction have been provided. While only certain presently preferred embodiments have been described in detail, as will be apparent to those familiar with the art, certain changes and modifications can be made without departing from the scope of the invention as defined by the following claims.

I claim:

1. In a concrete slab foundation constructed on a pad of ground soil: a plurality of plastic domes arranged in a rectilinear array on the pad, each of said domes having a horizontally extending top wall, four side walls and an open bottom, a monolithic concrete structure poured over the domes consisting of a gridwork of criss-crossing ribs between the side walls and a horizontally extending deck above the top walls, tendons extending longitudinally within the ribs and prestressing the concrete, and the plastic domes serving as a moisture barrier at the under side of the deck and the lateral faces of the ribs.

2. The foundation of claim 1 wherein the ribs are tapered, with the upper portions of the ribs being of greater lateral dimension than the lower portions.

3. The foundation of claim 2 wherein the tendons are positioned in the upper portions of the ribs.

4. The foundation of claim 1 wherein the deck spans about 36 inches between adjacent ones of the ribs, the under side of the deck is spaced above the pad by a distance on the order of 12 inches, and the ribs have a thickness on the order of 6 inches immediately below the deck and 4 inches adjacent to the pad.

5. The foundation of claim 4 wherein the deck has a thickness on the order of 4 inches, and the tendons are positioned about 4½ inches below the upper surface of the deck.

6. In a method of constructing a concrete slab foundation on ground soil, the steps of: grading the soil to form a building pad, placing a plurality of plastic domes having top and side walls in a rectilinear array on the pad, pouring concrete over the domes to form a monolithic structure consisting of a gridwork of criss-crossing ribs between the side walls and a horizontally extending deck above the top walls, prestressing the concrete with longitudinally extending tendons in the ribs, and leaving the plastic domes in place as a permanent part of the foundation to serve as a moisture barrier at the under side of the deck and the lateral faces of the ribs.

7. The method of claim 6 wherein the concrete is prestressed by placing the tendons in sheaths between the domes before the concrete is poured, tensioning the tendons after the concrete has cured, and anchoring the tensioned tendons to the concrete.

8. The method of claim 6 wherein the tendons are placed in the upper portions of the ribs.

9. The method of claim 6 wherein the domes are tapered, and the top walls are of lesser horizontal dimension than the bottoms of the domes.

10. The method of claim 9 wherein the top walls of the domes are on the order of 36 inches square, the bottoms of the domes are open and on the order of 38 inches square, the side walls of the domes are on the order of 12 inches high, and the top walls of adjacent ones of the domes are spaced apart by a distance on the order of 6 inches.

11. The method of claim 10 wherein the deck has a thickness on the order of 4 inches, and the tendons are positioned about 4½ inches below the upper surface of the deck.

12. In a method of constructing a concrete slab foundation on ground soil for a building having different floor levels, the steps of: grading the soil to a plurality of different levels to form a building pad having different levels corresponding to the different floor levels, placing a plurality of plastic domes having top and side walls in a rectilinear array on each level of the pad, the domes on the different levels all being of equal size, pouring concrete over the domes to form a monolithic structure consisting of a gridwork of criss-crossing ribs between the side walls and a horizontally extending deck above the top walls, the ribs all being of uniform height and the deck being of uniform thickness throughout, prestressing the concrete with longitudinally extending tendons in the ribs, and leaving the plastic domes in place as a permanent part of the foundation to serve as a moisture barrier at the under side of the deck and the lateral faces of the ribs.

* * * * *